US006430108B1

(12) United States Patent
Pignol et al.

(10) Patent No.: US 6,430,108 B1
(45) Date of Patent: Aug. 6, 2002

(54) PYRO-ACOUSTIC GENERATOR FOR PROTECTING SUBMARINES AND SURFACE SHIPS

(75) Inventors: Marc Pignol, Plaisance du Touch; Philippe Mourry, Ramonville Saint Agne, both of (FR)

(73) Assignee: Etienne Lacroix Tous Artifices S.A. (FR)

( * ) Notice: Subject to any disclaimer, the term of this patent is extended or adjusted under 35 U.S.C. 154(b) by 0 days.

(21) Appl. No.: 09/581,273

(22) PCT Filed: Dec. 1, 1998

(86) PCT No.: PCT/FR98/02578

§ 371 (c)(1),
(2), (4) Date: Oct. 16, 2000

(87) PCT Pub. No.: WO99/28699

PCT Pub. Date: Jun. 10, 1999

(30) Foreign Application Priority Data

Dec. 2, 1997 (FR) ..... 97 15144

(51) Int. Cl.[7] ..... F42B 12/36
(52) U.S. Cl. ..... 367/145
(58) Field of Search ..... 367/1, 145; 120/406, 120/418; 89/1.13, 36.17

(56) References Cited

U.S. PATENT DOCUMENTS

| | | | | |
|---|---|---|---|---|
| 3,097,600 A | * | 7/1963 | Hopkins | 102/390 |
| 3,799,094 A | * | 3/1974 | Hill | 102/293 |
| 3,808,940 A | * | 5/1974 | Schilreff et al. | 89/1.1 |
| 4,975,890 A | * | 12/1990 | Wolf et al. | 367/131 |
| 5,117,731 A | * | 6/1992 | Mendenhall | 367/1 |
| 5,341,343 A | * | 8/1994 | Aske | 367/145 |
| 5,341,718 A | * | 8/1994 | Woodall, Jr. et al. | 89/1.11 |

* cited by examiner

*Primary Examiner*—Daniel T. Pihulic
(74) *Attorney, Agent, or Firm*—Blakely Sokoloff Taylor & Zafman

(57) ABSTRACT

The present invention provide a pyroacoustic device for protecting submarines or surface vessels, the device being characterized by the fact that it comprises:

a structure (240) suitable for forming a positioning device for controlled positioning under water; and a case (100) connected to the positioning device, which case (100) contains:

a plurality of charges (110) each suitable for generating an acoustic effect; and control means (125, 126; 140; 121) suitable for initiating said plurality of charges (110) in a controlled sequence.

36 Claims, 7 Drawing Sheets

110
111
112
113
114
115
115
117
118
122
124
125
126
100
110
120
122
130
0
0

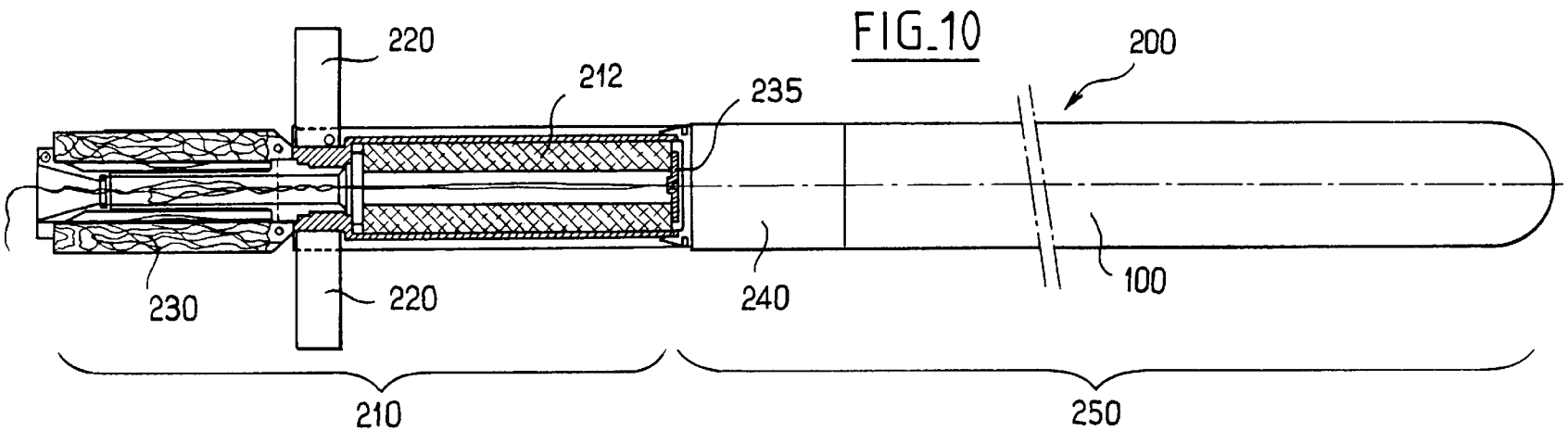
FIG_10
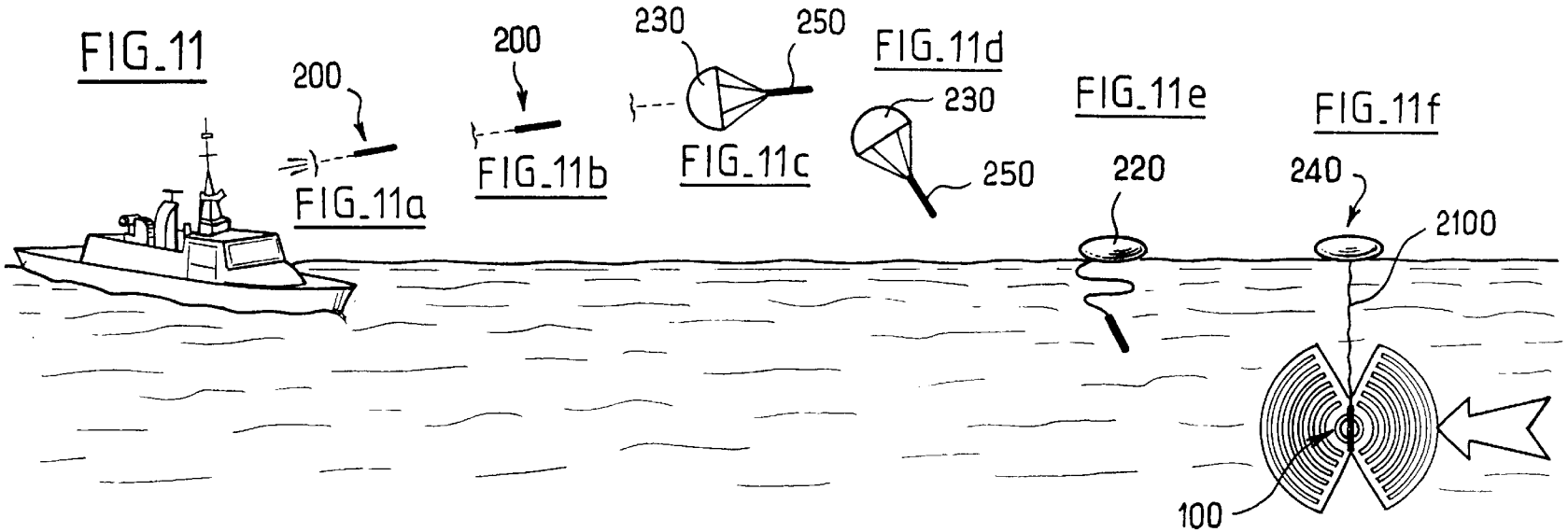
FIG_11f
FIG_11e
FIG_11d
FIG_11c
FIG_11b
FIG_11a
FIG_11

PYRO-ACOUSTIC GENERATOR FOR PROTECTING SUBMARINES AND SURFACE SHIPS

The present invention relates to a pyroacoustic device constituting a jammer or decoy for protecting sub-marines or surface vessels.

Document U.S. Pat. No. 3,799,094 describes a pyrotechnic device for diverting an underwater system. The device comprises a vehicle which carries a plurality of charges that are distributed generally over a cylinder centered on a horizontal axis. The charges are urged radially outwards by respective springs and they are freed cyclically by a rod driven in rotation by a shaft. Each of the charges has a membrane so that as the charge sinks, the pressure on the payload increases, leading at a given depth, to heating capable of causing initiation. The document thus describes a device in accordance with the preamble of accompanying claim 1.

An object of the present invention is to propose a novel device that is more effective than previously known devices against the homing systems of torpedoes.

In the context of the present invention, this object is achieved by a device comprising:

- a structure suitable for forming a positioning device for controlled positioning under water; and
- a case connected to the positioning device, which case contains:
  - a plurality of charges each suitable for generating an acoustic effect; and
  - control means suitable for initiating said plurality of charges in a controlled sequence characterized by the fact that the control means are adapted to define a time interval between initiation of two successive charges lying in the range 0.2 seconds (s) to 0.5 s.

Other characteristics, objects, and advantages of the present invention appear on reading the following detailed description and on examining the accompanying drawings, given as non-limiting examples, and in which:

FIG. 10 shows a rocket designed to implement the device of the invention;

FIG. 11 is a diagram showing the operation of the device of the invention;

Figures 1, 2:
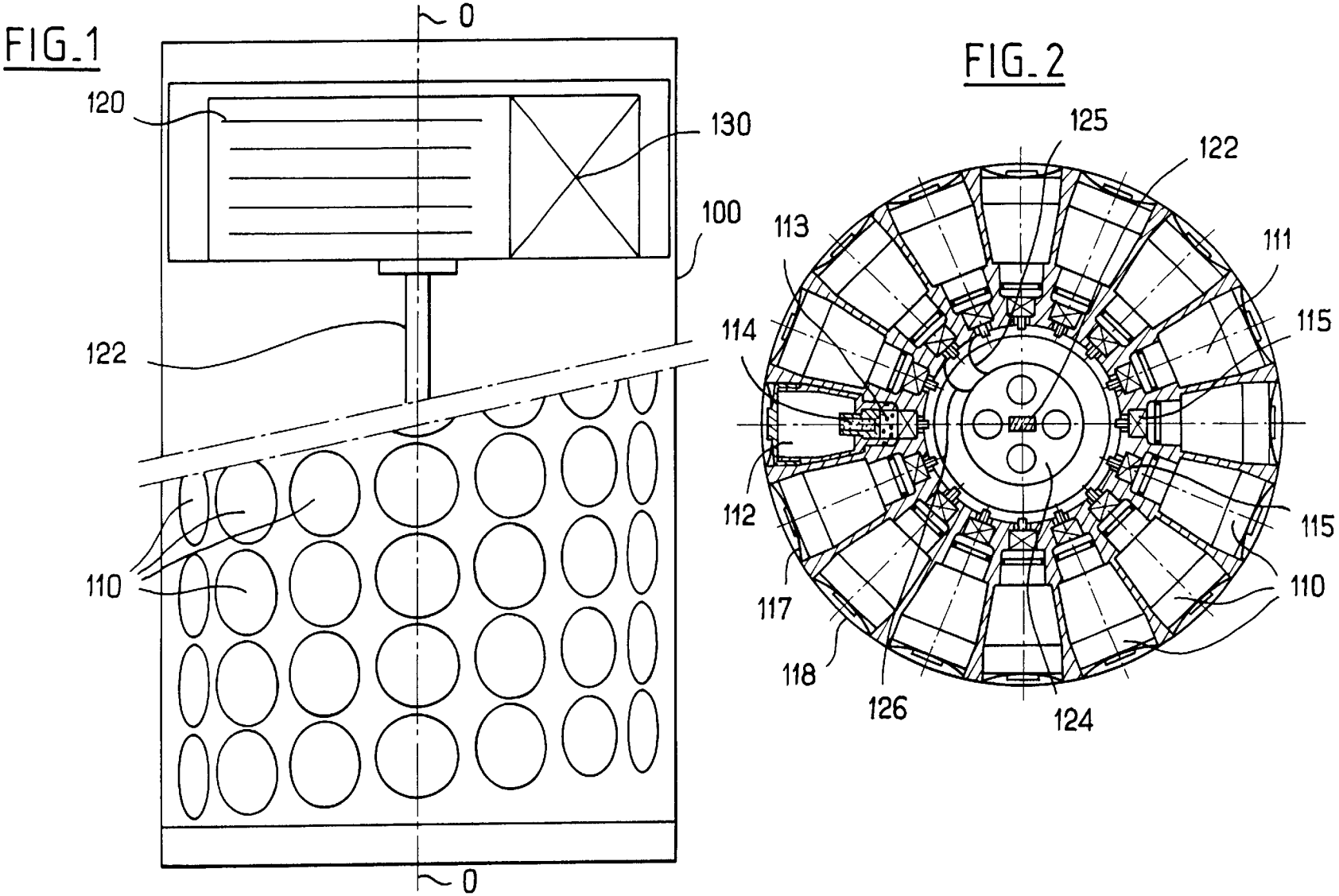
FIG. 1 is a diagram of a case of the present invention, the top half view being in longitudinal section and the bottom half view being a side view.
FIG. 2 is a cross-section view of said structure.

In FIG. 1, there can be seen a circularly cylindrical case 100 having an axis o—o that is vertical in use. The case 100 is connected to a positioning structure for controlled positioning under water. Such an underwater positioning structure can be implemented in numerous different ways. It preferably comprises an inflatable buoy 240 to which the case 100 is connected by a rope 2100, as described below.

However, in a variant, the positioning structure need not comprise an inflatable buoy, but may be a buoy that is already inflated or indeed any equivalent means suitable for floating on the water so as to support the case 100 by means of a rope 2100, or indeed any means suitable for controlling the sinking speed of the case 100. Thus, in a variant, the positioning structure need not comprise an element that floats on the surface of the water, but an element such as a parachute canopy adapted for controlling the rate at which the case 100 sinks in water.

The case 100 houses a plurality of charges 110 each adapted to generate an acoustic effect. As shown in FIG. 1, these charges 110 open out to the outside surface of the case 100 and are distributed on a helix centered on the axis o—o.

In addition, the case 100 houses means adapted to initiate the charges 110 in succession at a controlled rate.

In FIGS. 1 and 2, these means are constituted by a motor and gear-box unit 120 placed in the top portion of the case 100 and associated with a battery power supply 130. The motor unit 120 rotates a shaft 122 centered on the axis o—o. The shaft 122 is not circularly cylindrical. It is engaged in a plate 124 which itself is engaged in a spiral guide formed inside the case 100 and it also carries at least one electrically conductive brush 125, and preferably two electrically conductive brushes 125 and 126, so that when the shaft 122 is rotated by the motor 120, the brushes 125 and 126 come successively into contact with ignitor studs of the various charges 110.

Each of the charges 110 is preferably constituted by a generally circularly cylindrical case 111 engaged radially towards the inside of the case 100. Each case 111 houses a sound composition 112. At its radially inner end, each case 111 is provided with an ejector unit 113, inside which each case 111 further has a pyrotechnic delay 114. In addition, an electrical ignitor 115 is carried by the structure of the case 100 receiving the charges 110 in register with each ejector unit 113. Each ignitor 115 communicates with one ejector 113. Furthermore, each ignitor 115 has a power supply terminal in contact with the electrically conductive case 100 and a second terminal that is accessible to the path followed by the brushes 125 and 126.

Thus, the person skilled in the art will readily understand that when an initiation voltage is applied between ground as constituted by the case 100 and the brushes 125 and 126 by means of the shaft 122, then rotating the motor 120 serves to feed electricity to the ignitors 115 in succession and consequently to eject the various charges 110 successively by initiating their ejector units 113. The corresponding delay 114 initiated by the ejector unit 113 serves at the end of combustion to initiate the associated sound composition 112.

By way of non-limiting example, the case 100 may contain 700 charges 110 that are implemented at 0.25 s intervals.

Figure 4:
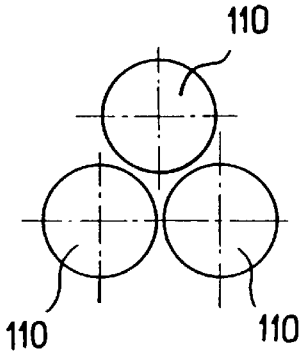
FIG. 4 shows a variant, staggered arrangement of charges in accordance with the invention.

FIG. 4 shows a variant arrangement in which the charges 110 are stored in a staggered configuration, thereby making it possible to reduce the height of the case 100.

Preferably, sealing is provided between each charge 110 and the case 100, e.g. by an o-ring 116 engaged on the radially inner end of each case 111.

Each case 111 is preferably held in the case 100 by means that are suitable for releasing when the ejector unit 113 is implemented. Such temporary retention means can be implemented, for example, by means of respective toothed washers 117 engaged on respective studs 118 formed on the radially outer surface of each case 111 and also engaging the inside surface of each housing in the case 100 for receiving a charge 110.

Figure 5:
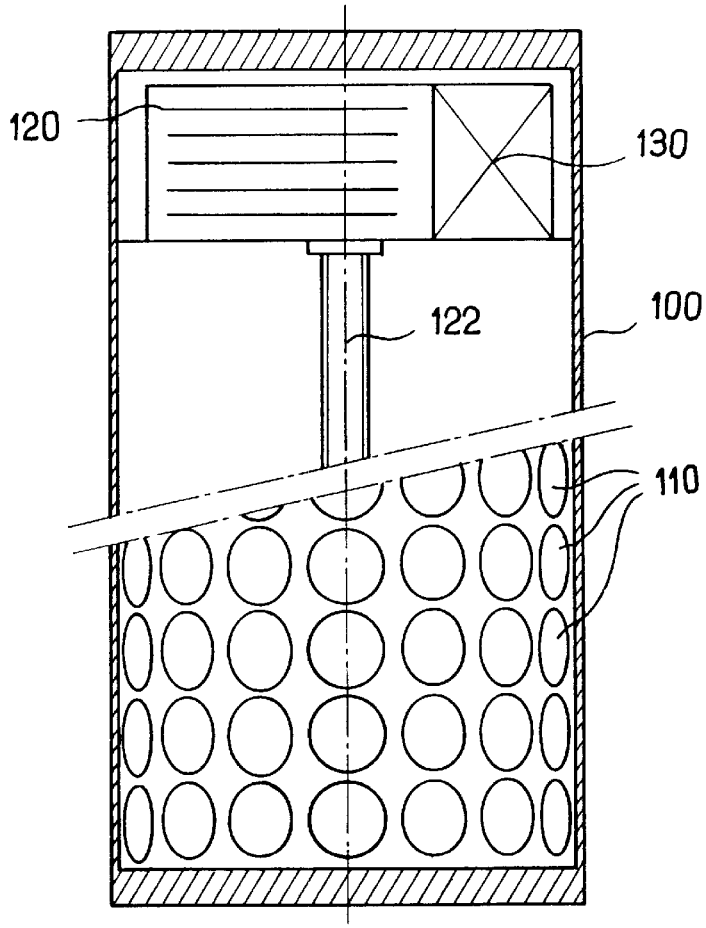
FIG. 5 is a view similar to FIG. 1 showing a case constituting a second embodiment of the invention.
Figure 3:
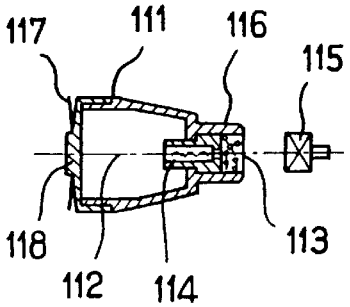
FIG. 3 is a diagram of a unit charge of the invention.

FIG. 5 shows a variant embodiment in which the charges 110 are not disposed in a helix, but as a plurality of disks that are stacked axially. In addition, the electrical ignitors 115 described with reference to FIGS. 1 to 3 are replaced by percussion caps 130 implemented by a rotary striker assembly 140 driven by the shaft 122 and controlled with timing supplied by an appropriate electronic circuit.

Figure 6:
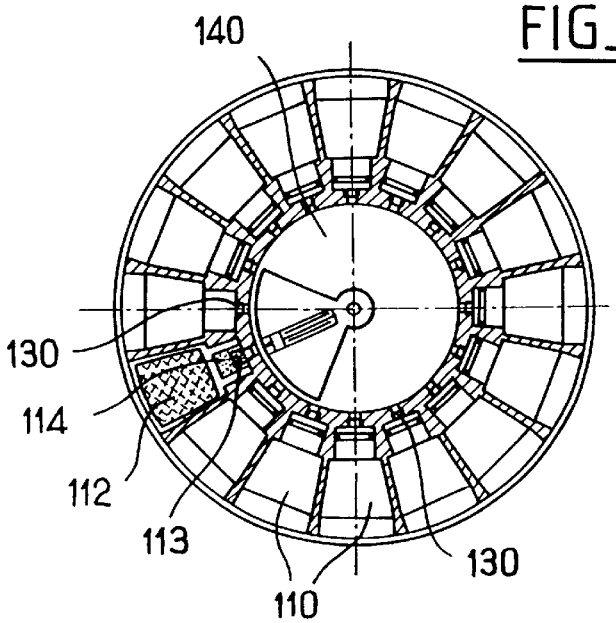
FIG. 6 is a cross-section view through said case.

The general operation of the device shown in FIGS. 5 and 6 is essentially identical to that described with reference to FIGS. 1 to 4.

When the battery 130 is activated, it powers the motor 120. This rotates the rotary striker assembly 140 which is designed to strike the percussion caps 130 automatically as it moves, and at an appropriate rate. On being struck, the caps 130 initiate the pyrotechnic ejector units 113 which fire the pyrotechnic delays 114 and eject the unit pyroacoustic charges 110.

At the end of its combustion, each pyrotechnic delay 114 initiates the associated sound composition 112, thus creating the looked-for acoustic effect.

Figure 7:
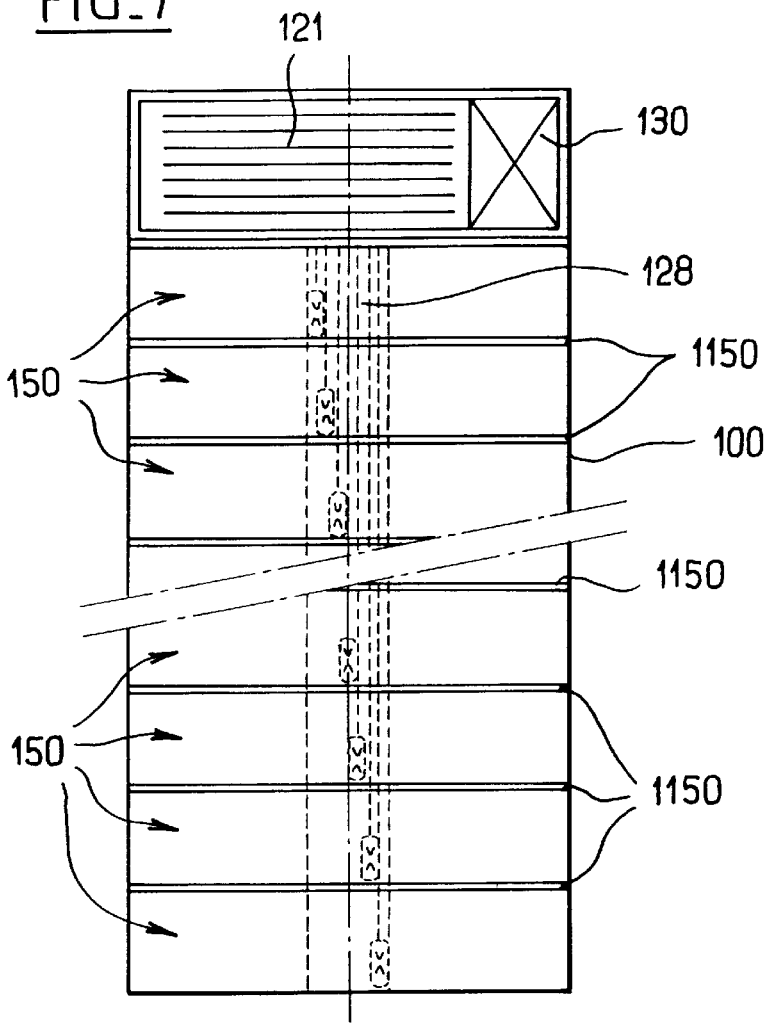
FIG. 7 is a view similar to FIG. 1 showing a case constituting a third embodiment of the invention.
Figure 8:
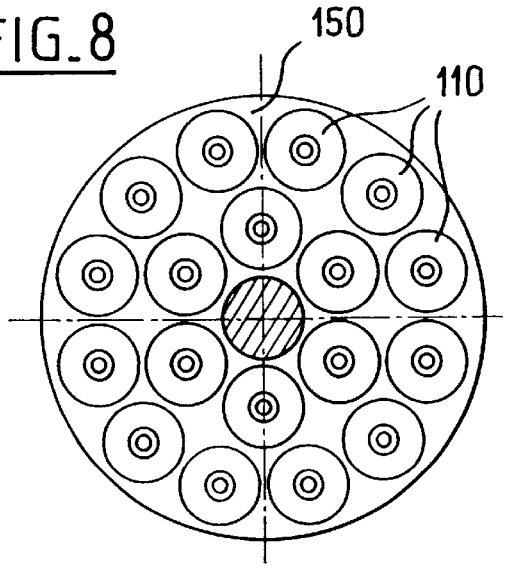
FIG. 8 is a plan view of a tray of charges in the third embodiment.
Figure 9:
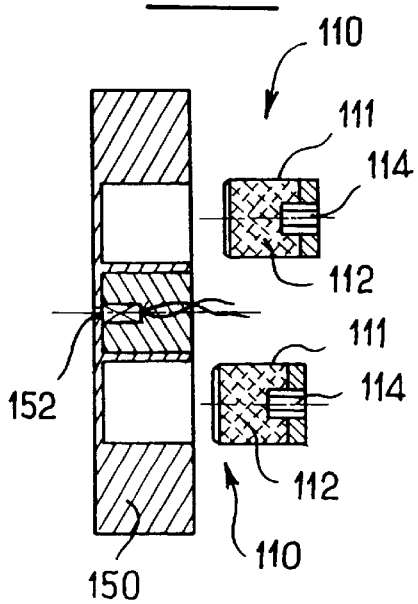
FIG. 9 shows how charges are implemented in such a tray.

FIGS. 7 to 9 show another variant in which the case 100 receives a plurality of circular trays 150 that are stacked axially. As shown in FIGS. 8 and 9, each tray 150 itself receives a plurality of unit charges 110, in chambers that open out axially into one of the main surfaces of the tray 150, extending orthogonally to the axis o—o in storage. The case 100 can thus house, for example, 30 trays each containing, for example 18 charges 110.

The motor 120 is replaced by an electronic unit 121 connected via a bundle of cables 128 to ejector units 1150 interposed between the trays 150. In addition, each tray 150 carries an electrical ignitor 152, preferably in the central position.

Each charge 110 of the embodiment shown in FIGS. 7 to 9 has a body 111, preferably of plastics material, containing the sound composition 112, and a pyrotechnic delay 114.

The operating sequence of the device shown in FIGS. 7 to 9 is as follows.

Activation of the battery 130 powers the electronics unit 121. This initiates the electrical ignitors 152 of each tray with appropriate sequencing.

When an ignitor 152 is initiated, it ignites an associated ejector unit 1150, thereby separating the tray 150, releasing its unit pyroacoustic charges and igniting the set of pyrotechnic delays 114 of the charges 110. In any one tray, each delay 114 is of a different duration. At the end of its combustion, each pyrotechnic delay 114 initiates the associated sound composition 112, thus creating the looked-for acoustic effect. The sequencing of the electronic unit 121 is such that the end of combustion of the last delay 114 in a given tray 150 corresponds to the next tray 150 being initiated.

FIG. 10 shows a round of ammunition 200 suitable for being launched from a ship, for the purpose of implementing a countermeasure device of the present invention.

This round 200 comprises a body that is essentially circularly symmetrical about an axis o—o. The body has a primary portion 210 and a secondary portion 250.

The primary portion 210 is situated at the tail end of the rocket 200. It preferably houses stabilizer fins 220, an engine 212 (which engine may be a solid propellant motor), and preferably also a parachute assembly 230.

The secondary portion 250 houses the payload of the charge which comprises the buoy structure 240 and the case 100 containing the sound charges 110.

The round 200 preferably also has a pyrotechnic thruster 235 placed between the primary portion 210 and the secondary portion 250 to separate the engine 212 from the payload 240/100 on initiation thereof. A second thruster situated in the nosecone of the rocket can also be used, after firing, to drive a piston for expelling the payload 240/100 from its container tube so as to release the countermeasure device. The first and second thrusters can be fired, for example, by means of an electronic device.

Naturally, the representation given in accompanying FIG. 10 is given purely by way of non-limiting example. It can be varied in numerous ways. Thus, for example, the parachute assembly 230 could be housed in the secondary portion 250 instead of in the primary portion 210.

The engine 212 could indeed be associated with an asymmetrical parachute for changing the trajectory of the engine 212 after the first thruster has been initiated so as to ensure that the engine does not interfere with the trajectory of the payload 240/100. Such an asymmetrical parachute may be as described in document FR-A-2 724 222.

The system of the present invention operates essentially as follows.

The round is fired with elevation and flight time determined accurately so that it reaches the desired range (FIGS. 11*a* and 11*b*).

At an instant in flight as programmed by the launcher, the pyrotechnic system is initiated and the rear thruster is fired. This separates the engine 212 from the payload 240/100. The engine 212 is ejected rearwards. The as-yet-undeployed brake parachute 230 and the payload 240/100 are ejected forwards. A halyard interconnecting the above two assemblies is paid out until it comes under tension.

The above-mentioned asymmetrical canopy fixed to said halyard deploys and inflates so as to change the trajectory of the engine 212 which continues its trajectory under the asymmetrical canopy 124 until it hits the water.

When the above-mentioned halyard is tensioned, it pulls on a bag containing the canopy of the brake parachute 230, thereby paying out its suspension lines. Once the suspension lines are tensioned, the bag releases the asymmetrical canopy and there is no longer any connection between the engine 212 and the payload 240/100. The canopy of the brake parachute 230 inflates over very quickly and begins to brake the payload 240/100 (FIG. 1*c*).

At the end of its trajectory, the payload 240/100 also reaches the surface of the water.

When this happens, a sensor ensures that the buoy structure 240 is separated from the case 100 and allows a link rope 2100 to be paid out between them.

The case 100 is initiated when the rope 2100 on which the case 100 is suspended from the buoy structure 240 becomes taut.

The case 100 and the unit charges 110 it contains operate as described above.

The buoy structure 240 may be inflated by any appropriate means on impact with the water, for example by means of a CO2 capsule activated by a striker which is itself released when a block of salt (e.g. NaCl) dissolves on coming into contact with the water.

The means providing temporary connection, prior to hitting the water, between the buoy structure 240 and the case 100 can be implemented in numerous ways.

Figure 12:
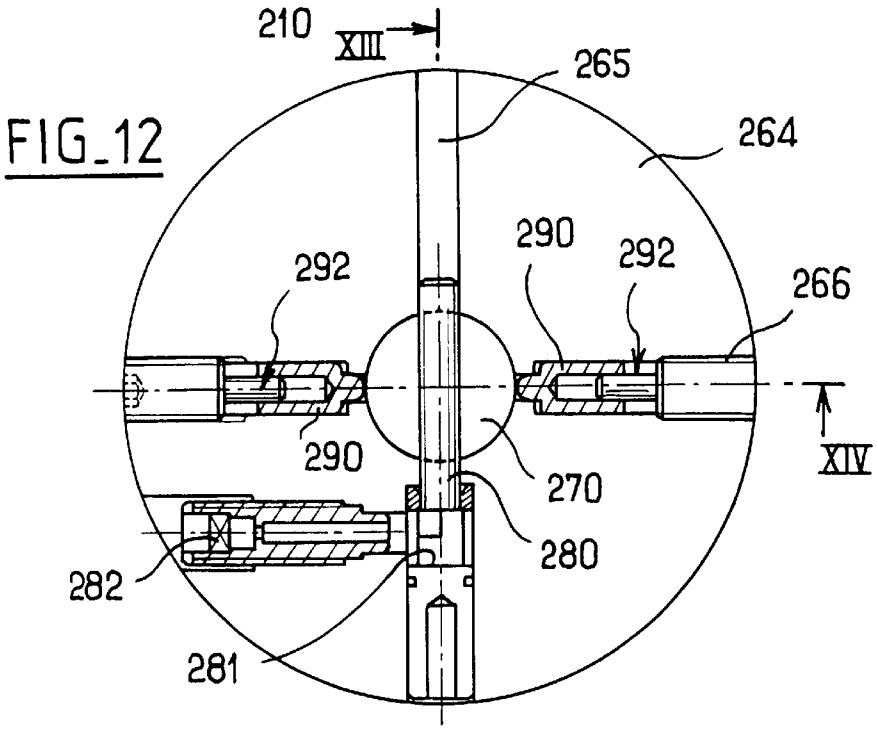
FIG. 12 is a cross-section view of a base for linking a buoy and the case.
Figure 13:
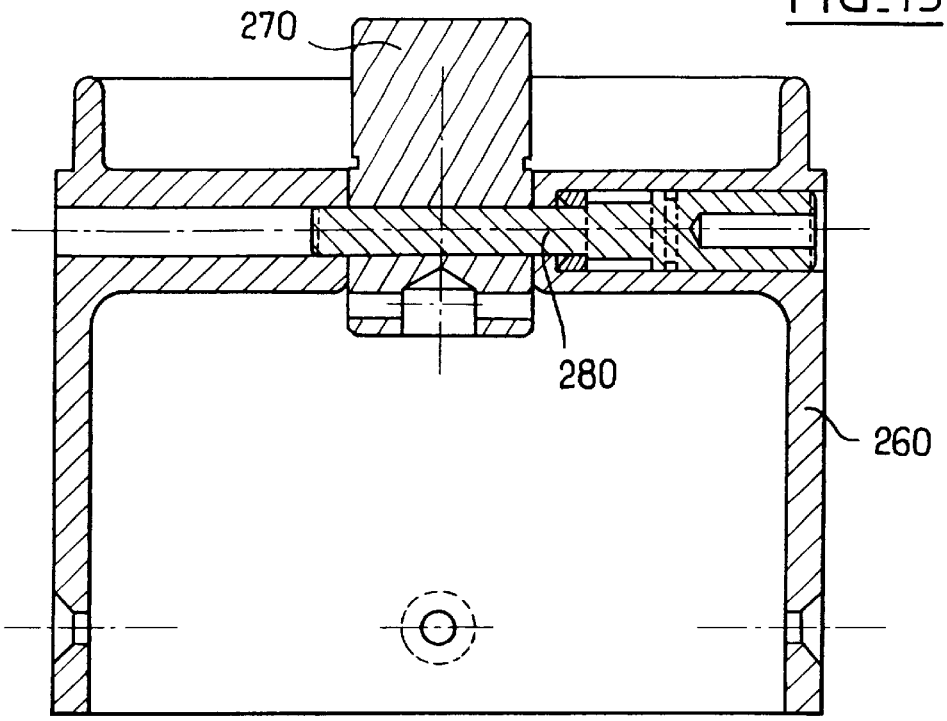
FIGS. 13 and 14 are longitudinal section views of the base respectively on section planes referenced XIII and XIV in FIG. 12.
Figure 14:
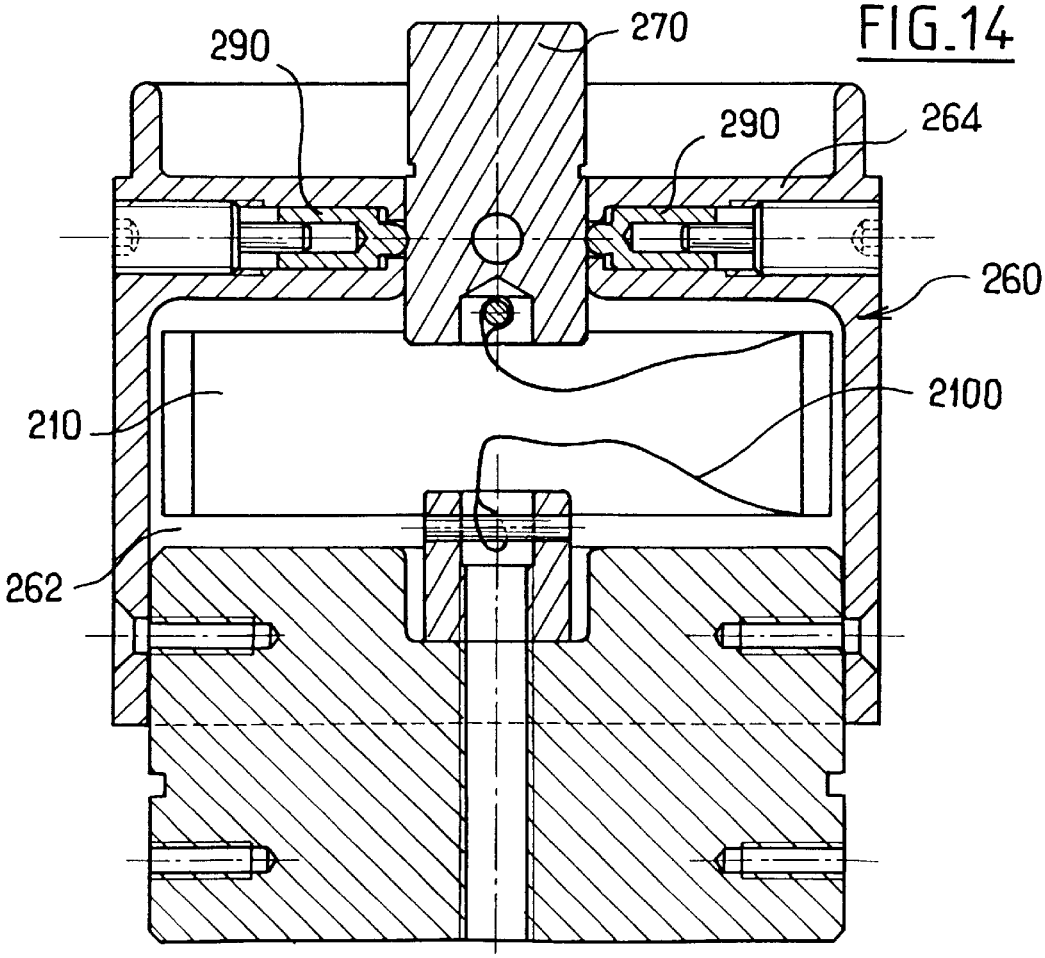

FIGS. 12 to 14 show an embodiment of such means.

In these figures, there can be seen a base 260 designed to be fixed to the top of the case 100.

The base 260 has a housing 262 receiving a coil of rope 2100.

At this level, one of the ends of the rope 2100 is connected to the base 260 and consequently indirectly to the case 100. The other end of the rope 2100 is connected to a stud 270 which is itself secured to the buoy structure 240.

The stud 270 is held to the top of the base 260 by temporary retaining means.

These temporary retaining means can be implemented in numerous ways.

By way of example, they may be shear pins adapted to break on impact against the water, so as to allow the buoy structure 240 to separate from the case 100 and the rope 2100 to be paid out.

However, in the preferred embodiment shown in the accompanying figures, the stud 270 is held firstly by an ejectable pin 280 and secondly by pegs 290 urged into engagement with the stud 270 by a rated force.

The pin 280 and the pegs 290 are placed in a top plate 264 of the base 260.

The pin 280 is thus placed in a passage 265 formed radially in the plate 264. At rest, the pin passes through a complementary bore formed in the stud 270 so as to prevent it from being withdrawn.

For the purpose of releasing the stud 270, the pin 280 is ejected on impact against the water by gas pressure which is generated by an electrical cap 282. For that purpose, and as can be seen in the accompanying figures, the cap 282 is placed in a housing in the plate 264 which is in communication with the passage 265 upstream from a notch 281 formed in the pin 280.

Once the pin 280 has been withdrawn, the stud is held to the base 260 only by the pegs 290.

It is preferable to provide two diametrically opposite pegs 290 placed in complementary passages 266 formed in the plate 264 at 90° to the passage 265. The rounded radially inner heads of the pegs 290 rest in a groove formed in the periphery of the stud 270.

The pegs 290 are kept in engagement with the stud 270 under a rated force controlled by any appropriate means. By way of non-limiting example, the pegs 290 can be held in the passages 266 by an arrangement of spring washers 292.

In a variant, the pin 280 can be withdrawn in flight, such that the pegs 290 release the stud on impact against the water.

Naturally, the present invention is not limited to the particular embodiments described above, but extends to any variant within the spirit of the invention.

Thus, for example, although the unit charges 110 are implemented outside the case 100 in the embodiments described above, it is possible in a variant to envisage implementing them while they are in their storage positions in the case, providing the cases 100 and 111 are adapted to avoid any risk of a charge 110 initiating an adjacent charge.

In the context of the present invention, the charges 110 are preferably implemented from the bottom of the case 100 upwards, so as to avoid charges initiating one another, since the charges 110 have a tendency to sink after being released from the case 100.

In the context of the present invention, the time interval between two successive charges 110 being initiated typically lies in the range 0.2 s to 0.5 s, and preferably in the range 0.2 s to 0.25 s.

In yet another variant, the case 100 can be covered in a frangible skin, e.g. of plastics material, adapted to break when a charge 110 is implemented.

Figure 15:
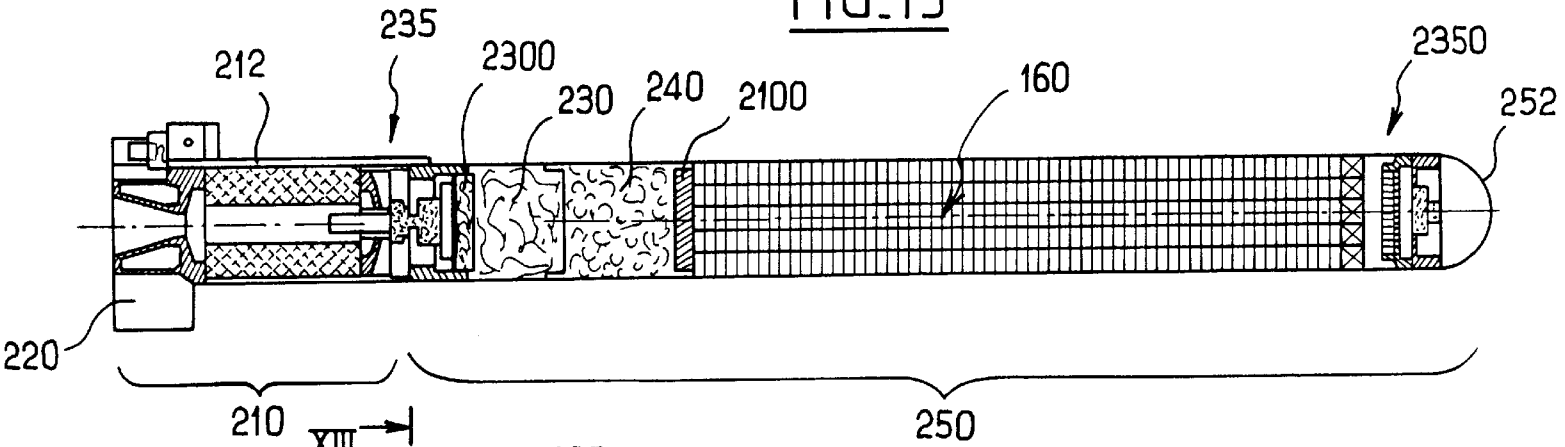
FIG. 15 is a longitudinal section view of a rocket constituting another embodiment of the present invention.
Figure 16:
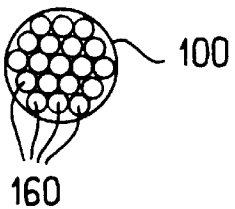
FIG. 16 is a cross-section view of said rocket.
Figure 17:
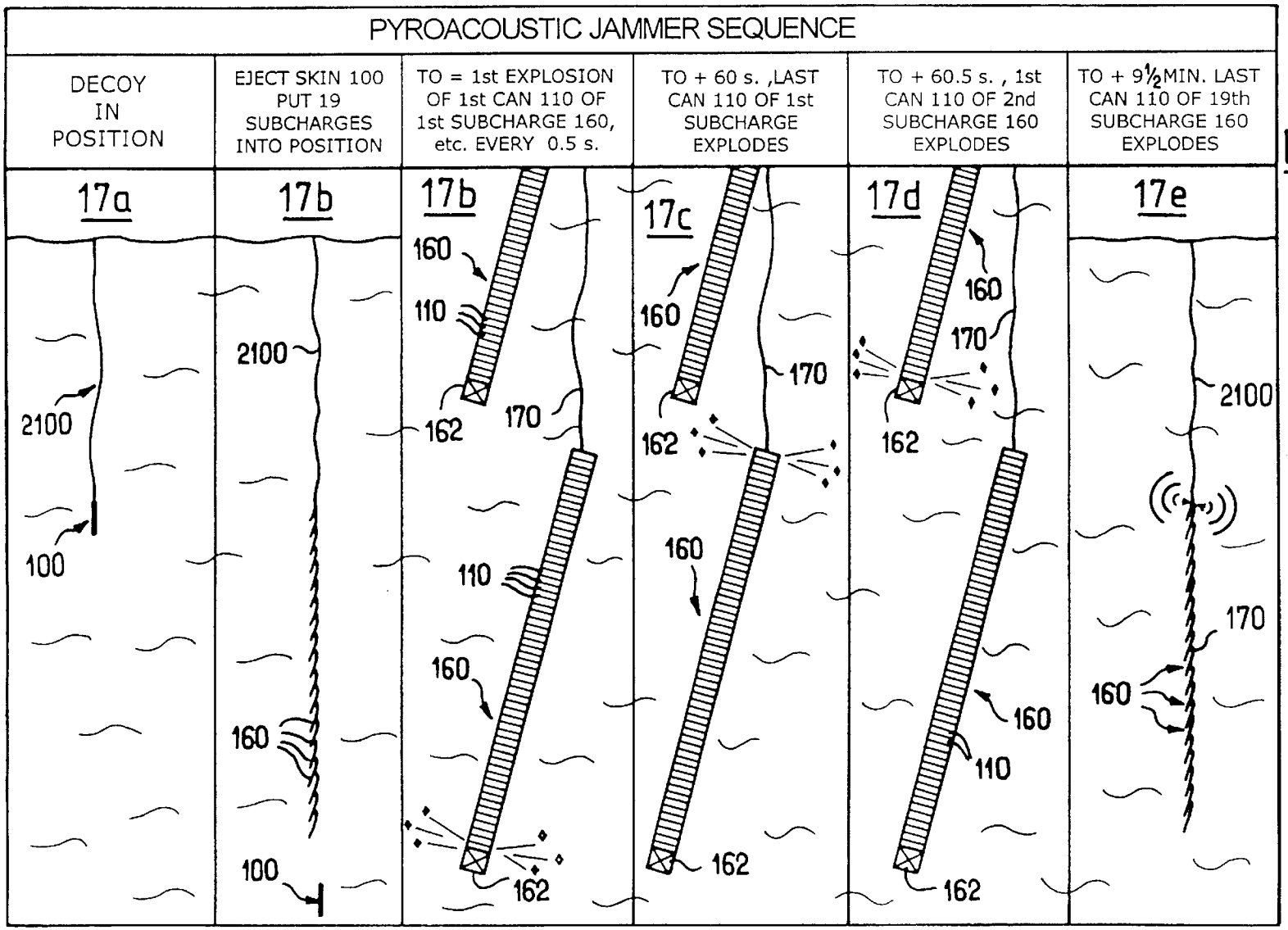
FIG. 17 is a diagram showing the implementation sequence of the pyrotechnic device constituting this embodiment of the present invention.

The embodiment shown in FIGS. 15 to 17 is described below.

As in the embodiments described above, the embodiment shown in FIGS. 15 to 17 is adapted to emit an interrupted signal at high level that results from the successive timed pressure fronts created by pyrotechnic reactions.

In this variant, the pyroacoustic generator has a plurality of subcharges or submunitions 160 inter-connected by halyards 170. The halyards 170 also provide a link with the rope 2100 suspended from the buoy 240 or from any equivalent positioning means.

Each submunition 160 is formed by an axial stack of a plurality of unit charges or cans 110.

The halyards 170 are preferably adapted, as can be seen in FIG. 17, so that once deployed the various sub-charges 160 form an almost continuous rope of unit charges 110. That is to say the top end of a given sub-munition 160 coincides substantially with the bottom end of the adjacent submunition 160 above it.

By way of non-limiting example, 19 submunitions 160 can thus be provided, each having 60 unit charges 110.

The generator also has first delay means 162 adapted to initiate the various subcharges 160 in succession, and second delay means adapted to initiate the various unit charges 110 of a submunition 160, likewise in succession.

The first delay means 162 are preferably constituted by electronic means integrated in the base of each sub-munition 160. The second delay means are preferably formed by pyrotechnic delays integrated in each of the unit charges 110, respectively.

In this way, each unit charge 110 is preferably in the form of a cylindrical can containing a pyrotechnic composition and a pyrotechnic delay body.

The delay means are preferably adapted to start initiating charges with the bottom submunition 160, and within each submunition 160, to start initiating charges with the bottom unit charge 110.

The delay means preferably define identical timing for the various submunitions 160.

In addition, the delay means are preferably adapted so that the time between initiation of the last unit charge 110 in a given submunition 160 and initiation of the first unit charge 110 in the following submunition 160 is identical to the time interval between initiation of unit charges within each of the submunitions 160.

The rocket 200 shown in FIG. 15 for implementing this device essentially comprises a rear portion 210 which includes an engine 212 associated with fins 220, and a front portion 250 which comprises, from its rear end towards its front end: a parachute compartment 230, a buoy compartment 240, and the payload constituted by sub-munitions 160 in a case or cylinder 100.

A pyrotechnic thruster 235 is placed between the rear portion 210 and the front portion 250 to separate them when it is initiated. In this case also, it is preferable for a second thruster 2350 to be situated in the nosecone 252 of the rocket to expel the submunitions 160 from the cylinder 100 on command.

In addition, the rocket preferably also has an asymmetrical parachute 2300, as described above, for the purpose of changing the trajectory of the engine 212 after separation so as to ensure that the engine 212 does not interfere with the trajectory of the payload 160.

The submunitions 160, each of which comprises a stack of subcharges 110, are juxtaposed side by side in the cylinder 100, as can be seen in FIGS. 15 and 16, in particular.

The device shown in FIGS. 15 to 17 essentially operates as follows.

In flight, a safety device and a power source are activated. After being positioned at the desired immersion depth, the nosecone 252 and the case 100 are ejected, releasing the submunitions 160, as can be seen in FIGS. 17*a* (before ejection of the cylinder 100) and 17*b* (after ejection of the cylinder 100).

Thereafter, the operating sequence is controlled by long electronic delays 162 associated respectively with the submunitions 160 operating in parallel, and by short pyrotechnic delays integrated respectively in each unit charge 110, the two delays operating in series. Each unit charge 110 is initiated by a delay and operates to generate a pressure wave. The way these pressure waves are sequenced constitutes interrupted noise of long duration, suitable for jamming the sensors of torpedoes or of submarines.

The pyroacoustic device of the present invention can be adapted to jam submarines only or to jam both sub-marines and torpedoes. In the first case, the repetition rate is preferably less than half that of the second case, thereby enabling the device to operate for twice as long.

Furthermore, in the context of the present invention, it is possible either to provide for projecting the pyroacoustic device over a considerable distance, as described above, or else to release it or project it over a short distance. In the first case, the pyroacoustic generator is packaged so as to be carried by a rocket as described above. In the second case, constraints on mass and volume are different, so for substantially constant cost it is possible to double the operating time of the pyroacoustic generator. In the second case, the device may be released by means of a pneumatic launcher or can simply be dropped by gravity overboard, manually or by means of a downwardly-sloping launcher. When put into place in the immediate vicinity of a vessel, the pyrotechnic sequence can either be initiated immediately, or it can be initiated after a delay. Under such circumstances, it must be possible, prior to release, to be able to program an initiation delay that may be as much as 5 minutes, and typically, when four pyroacoustic generators are released in succession, their initiation delays should be 5 s, 80 s, 120 s, and 180 s.

What is claimed is:

1. A pyroacoustic device for protecting submarines or surface vessels, the device being characterized by the fact that it comprises:

a structure (240) suitable for forming a positioning device for controlled positioning under water; and a case (100) connected to the positioning device, which case (100) contains:

a plurality of charges (110) each suitable for generating an acoustic effect; and control means (125, 126; 140; 121) suitable for initiating said plurality of charges (110) in a controlled sequence characterized by the fact that the control means are adapted to define a time interval between initiation of two successive charges lying in the range 0.2 s to 0.5 s.

2. A device according to claim 1, characterized by the fact that the time interval between initiation of two successive charges (110) lies in the range 0.2 s to 0.25 s.

3. A device according to claim 1 or 2, characterized by the fact that the case (100) is covered in a skin suitable for being broken on each occasion a charge (110) is implemented.

4. A device according to claim 1, characterized by the fact that the control means comprise an assembly of electrically conductive brushes (125, 126) displaced in register with ignitor studs (115) of the charges (110).

5. A device according to claim 1, characterized by the fact that the control means comprise percussion caps (130) implemented by a striker assembly (140) controlled with timing determined by an electronic circuit.

6. A device according to claim 1, characterized by the fact that the control means comprise an electronic unit (121) controlling the timing of the charges (110).

7. A device according to claim 1, characterized by the fact that the charges (110) open out in the outside surface of the case (100).

8. A device according to claim 1, characterized by the fact that the charges (110) are distributed on a helix centered on the axis O—O of the case (100).

9. A device according to claim 1, characterized by the fact that the charges (110) are arranged in a staggered configuration.

10. A device according to claim 1, characterized by the fact that the charges (110) are disposed as a plurality of disks that are stacked axially.

11. A device according to claim 1, characterized by the fact that the case (100) houses a plurality of stacked circular trays (150) each housing the plurality of charges (110) in chambers which open out axially in one of the main faces of the trays (150).

12. A device according to claim 11, characterized by the fact that the case (100) includes ejector units (1150) interposed between the trays (150).

13. A device according to claim 11, characterized by the fact that each tray (150) includes an electrical ignitor (152) adapted to implement the charges (110).

14. A device according to claim 1, characterized by the fact that each of the charges (110) comprises a body (111) containing a sound composition (112) and a pyrotechnic delay (114).

15. A device according to claim 11, characterized by the fact that each charge of each tray (150) comprises a delay (114) and each delay has different duration than the other ones.

16. A device according to claim 15, characterized by the fact that the electronics unit (121) defines timing such that the end of combustion of the last delay (114) of a tray (150) corresponds to initiation of the following tray (150).

17. A device according to claim 1, characterized by the fact that each charge (110) is associated with an ejector unit (113).

18. A device according to claim 1, characterized by the fact that each charge (110) is held in the case (100) by means adapted to give way by use of an ejector unit (113).

19. A device according to claim 1, characterized by the fact that said device comprises a plurality of subcharges or submunitions (160) interconnected by halyards (170) which link them to the structure (240), each submunition (160) being formed by an axial stack of said plurality of charges (110).

20. A device according to claim 19, characterized by the fact that the halyards (170) are adapted so that the various subcharges (160) form a substantially continuous cord of unit charges (110), i.e. the top end of a given submunition (160) coincides substantially with the bottom end of the adjacent submunition (160) above it.

21. A device according to claim 19, characterized by the fact that said device further includes first delay means (162) adapted to initiate the submunitions (160) in succession, and second delay means adapted to initiate the charges (110) of a submunition (160) in succession.

22. A device according to claim 21, characterized by the fact that the first delay means (162) are formed by electronic means integrated in each submunition (160), while the second delay means are formed by pyrotechnic delays respectively integrated in each unit charge (110).

23. A device according to claim 21, characterized by the fact that the delay means are adapted to commence initiation of the charges from the submunition (160) below, and within a given submunition (160) from the charges (110) below.

24. A device according to claim 21, characterized by the fact that the delay means define timing that is identical for the various submunitions (160) and are adapted so that the time interval between initiation of a last one of the plurality of charges (110) of a given submunition (160) and initiation of a first one of a plurality of charges (110) of the following submunition (160) is identical to the time intervals between initiation of unit charges within each submunition (160).

25. A device according to claim 1, characterized by the fact that the case (100) is placed in a front portion (250) of a projectile whose rear portion (210) is fitted with an engine (212) and an asymmetrical canopy adapted to deflect the engine (212) onto a trajectory that is different from that of the front portion after the front and rear portions have separated.

26. A device according to claim 1, characterized by the fact that said device includes a base (260) connected to the case (100) and possessing a housing (262) receiving a coil of rope (2100), one of the ends of the rope (2100) being connected to the base (260) and consequently indirectly to the case (100), while the other end of the rope (2100) is connected to a stud (270) itself secured to the structure (240) and held to the top of the base (260) by temporary retaining means.

27. A device according to claim 26, characterized by the fact that the temporary retaining means comprise shear pins.

28. A device according to claim 26, characterized by the fact that the temporary retaining means comprise an ejectable pin (280) and pegs (290) urged to engage with the stud (270) by a rated force.

29. A device according to claim 28, characterized by the fact that it includes an electrical cap (282) suitable for controlling ejection of the pin (280).

30. A device according to claim 28, characterized by the fact that the pegs (290) are held in engagement with the stud (270) by an arrangement of spring washers (292).

31. A device according to claim 1, characterized by the fact that the structure (240) comprises an inflatable buoy.

32. A device according to claim 1, characterized by the fact that the structure (240) comprises a positioning device adapted to control the sink rate of the payload.

33. A device according to claim 1, characterized by the fact that the device comprises means for defining delayed initiation of the sequence, starting from release of the device.

34. A device according to claim 33, characterized by the fact that the means defining delayed initiation are programmable.

35. A device according to claim 33, characterized by the fact that the means defining delayed initiation are adapted to control initiation of four pyroacoustic generators released in succession so that their initiation delays are respectively 5 s, 80 s, 120 s, and 180 s.

36. A device according to claim 32 wherein said positioning device comprises a parachute canopy.

* * * * *